United States Patent [19]

Grandy

[11] Patent Number: 4,916,766

[45] Date of Patent: Apr. 17, 1990

[54] BED SHEET AND MATTRESS ATTACHMENT MEANS

[76] Inventor: Malcolm B. Grandy, 420 S. McDowell St., Suite 401, Releigh, N.C. 27601

[21] Appl. No.: 395,541

[22] Filed: Aug. 18, 1989

[51] Int. Cl.[4] ..... A47G 9/02

[52] U.S. Cl. ..... 5/496; 5/498; 5/499

[58] Field of Search ..... 5/402, 460, 470, 482, 5/486, 488, 494–500; 297/219, 229; 273/13

[56] References Cited

U.S. PATENT DOCUMENTS 3,066,321 12/1962 Kintner ..... 5/498
4,040,133 8/1977 Gilreath ..... 5/500 X
4,057,862 11/1977 LaBianco ..... 5/460 X
4,245,365 1/1981 Large ..... 5/496
4,488,323 12/1984 Colburn ..... 5/460

*Primary Examiner*—Michael F. Trettel
*Attorney, Agent, or Firm*—Rhodes, Coats & Bennett

[57] ABSTRACT

The present invention entails a mattress and mattress support set specifically adapted to enable a bed sheet to be quickly and easily attached to the underside of the mattress. In particular, the underside of the mattress is provided with a plurality of spaced fasteners that are adapted to be connected to cooperating fasteners secured to the bed sheet. Easy access is provided to the fasteners stationed to the underside of the mattress by the provision of a series of recesses formed around the side wall structure of the mattress support.

7 Claims, 2 Drawing Sheets

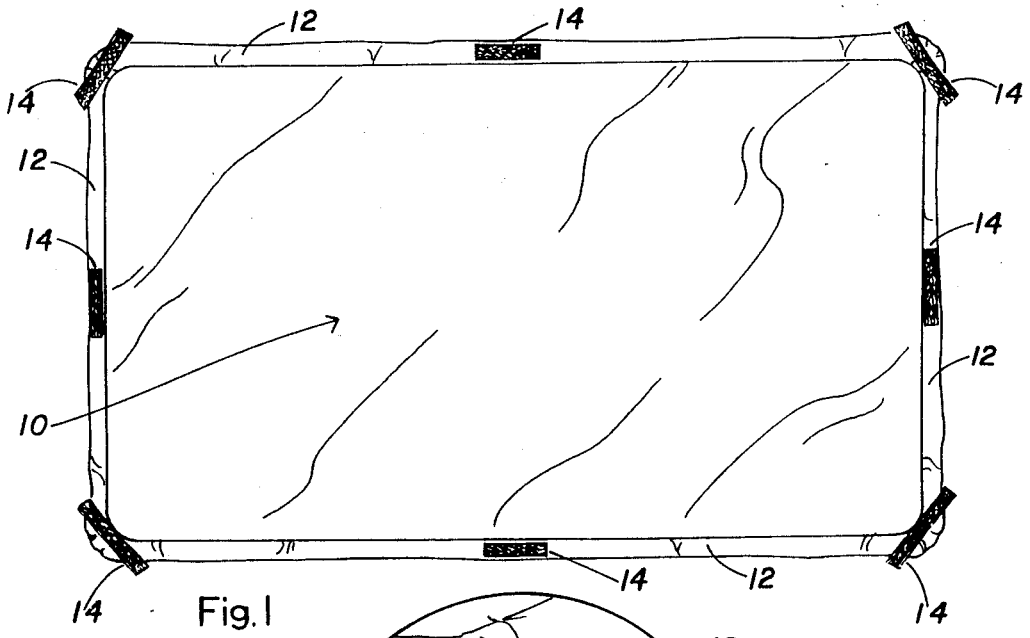
Fig. 1
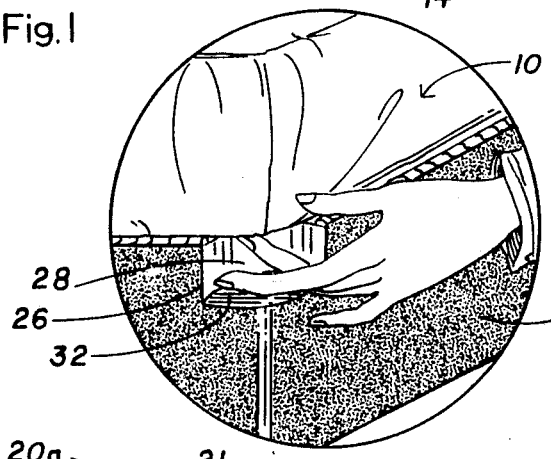
Fig. 2
Fig. 3
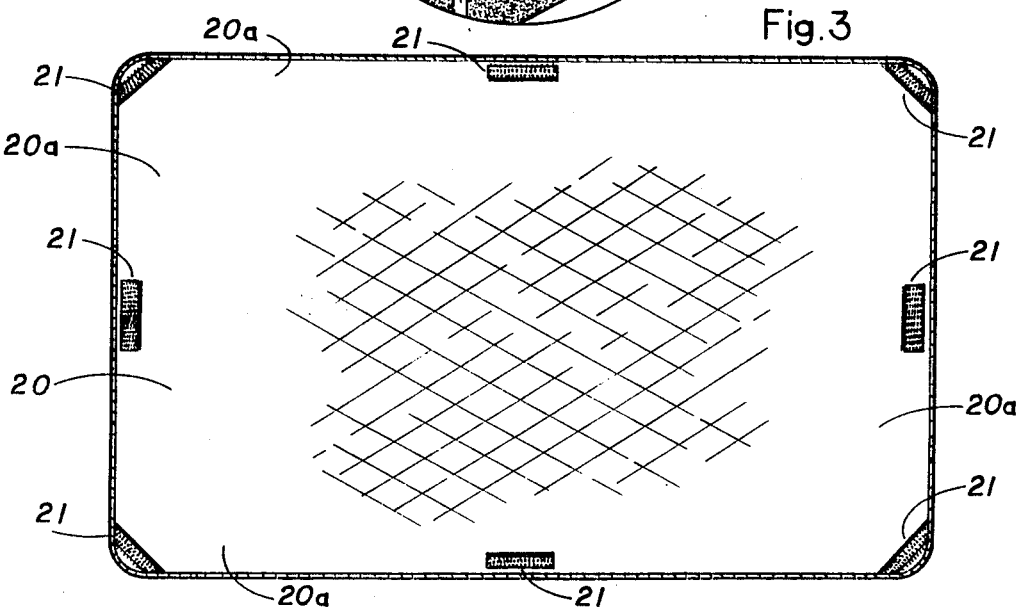

BED SHEET AND MATTRESS ATTACHMENT MEANS

FIELD OF THE INVENTION

This invention relates to beds and more particularly to devices and methods for conveniently attaching bed sheets to a mattress and mattress support.

BACKGROUND OF THE INVENTION

The importance of securely attaching a bed sheet to the underlying mattress and mattress support is well-known. Sheets not properly secured to the mattress become loose and misaligned more easily resulting in the need to remake the bed more often. In a hospital, for example, the necessity of remaking beds because the sheets become unattached can waste valuable time of hospital employees.

In order to decrease the frequency of having a remake a bed because of sheets becoming unattached from the mattress and mattress support, various attaching means between the bed sheet and mattress have been developed. For instance, one effective attaching means includes attaching velcro strips along the perimeter of the bed sheet to matching velcro strips located on the underside of the mattress. This and similar attaching means have proved effective in securing the bed sheet to the mattress and decreasing the frequency for which a bed must be remade due to misaligned sheets caused by ineffectively secured bed sheets.

However, the attaching means for a bed sheet as described above and for similar attachment means have the problem of not having a quick and efficient way to attach the attaching means of the bed sheet to the matching attaching means on the mattress. The matching velcro means on the mattress are most often located on the underside of the mattress. Thus, in order to secure the bed sheet, the mattress' matching velcro strips must be located and the mattress lifted in order to attach the corresponding velcro strips. Locating the velcro strips underneath the mattress and then lifting the mattress to secure the attaching means can take a significant amount of time and effort. A more efficient means of locating and then attaching the sheet to the mattress and mattress support would save time and make the use of velcro attaching methods more convenient.

BRIEF DESCRIPTION OF THE DRAWINGS

FIG. 1 is a plan view of the bottom of a bed sheet that assumes a stretched out or spread open position.

FIG. 2 is a fragmentary perspective view illustrating the attachment of a portion of the sheet to the underside of a mattress.

FIG. 3 is a bottom plan view of a mattress having cooperating fastening means located at selected positions about the underside perimeter of the mattress.

SUMMARY AND OBJECTS OF THE INVENTION

Figure 4:
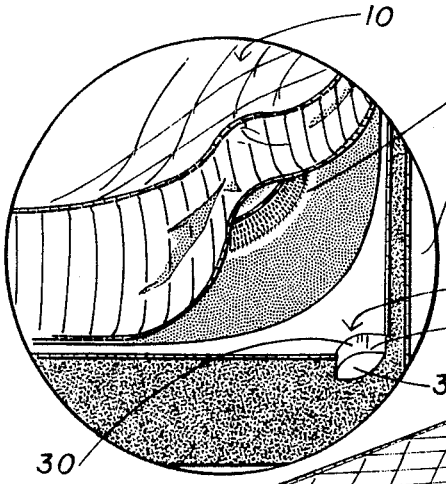
FIG. 4 is a fragmentary perspective view showing a portion of the sheet and mattress being raised above an underlying box springs or mattress support structure.

The present invention provides a more efficient means for attaching a bed sheet to a mattress and mattress support, where the attaching method includes a first attachment means on the perimeter of the bed sheet and a reciprocating second attachment means on the underside of the mattress. In the preferred embodiment, the first and second attachment means are first velcro strips and reciprocating second velcro strips, which when both are pressed together securely attach the bed sheet to the mattress. The mattress is supported by a mattress support having a top side and surrounding side walls, where the underside of the mattress rests against the top side of the mattress support. The second velcro strip is attached to the underside of the mattress such that it is disposed between the underside surface of the mattress and the top surface of the mattress support.

To provide convenient location and accessability of the second velcro strip attached to the mattress, the mattress support has recesses allowing easy location and attachment of the matching velcro strips without the necessity of lifting the mattress. The recesses are formed in the mattress support's surrounding side walls and top surface to form openings which expose the velcro means attached to the underside of the mattress. The first velcro means on the bed sheets can then be conveniently connected to the velcro means on the mattress without lifting the mattress by inserting the first velcro means through the openings of the recess and pressing the velcro means together.

It is an object of the present invention to provide a mattress and mattress support structure that will facilitate the attachment of a sheet to the underside of the mattress.

A further object of the present invention resides in the provision of a mattress and mattress support structure that will enable a sheet to be attached to the underside of the mattress without requiring the mattress itself to be lifted or moved.

Still a further object of the present invention resides in the provision of a cooperating loop and hook attachment means for attaching a bed sheet to the underside of a mattress wherein there is provided a mattress support structure that permits direct and instant access to the underside of the mattress for purposes of attaching the sheet to the same via the cooperating loop and hook attachment means.

DETAILED DESCRIPTION OF THE INVENTION

With further reference to the drawings, a conventional bed sheet is shown therein and indicated generally by the numeral 10. Bed sheet 10 includes a surrounding perimeter portion 12. Secured to the perimeter portion 12 at selected locations around sheet 10 is a first attachment means 14 that in the present case is of the "velcro" type, sometimes referred to as a hook and loop type connector. As shown in FIG. 1, the attachment strips 14 are secured at respective corners of the sheet as well as along opposite sides and ends of the sheet between opposite corners.

Figure 5:
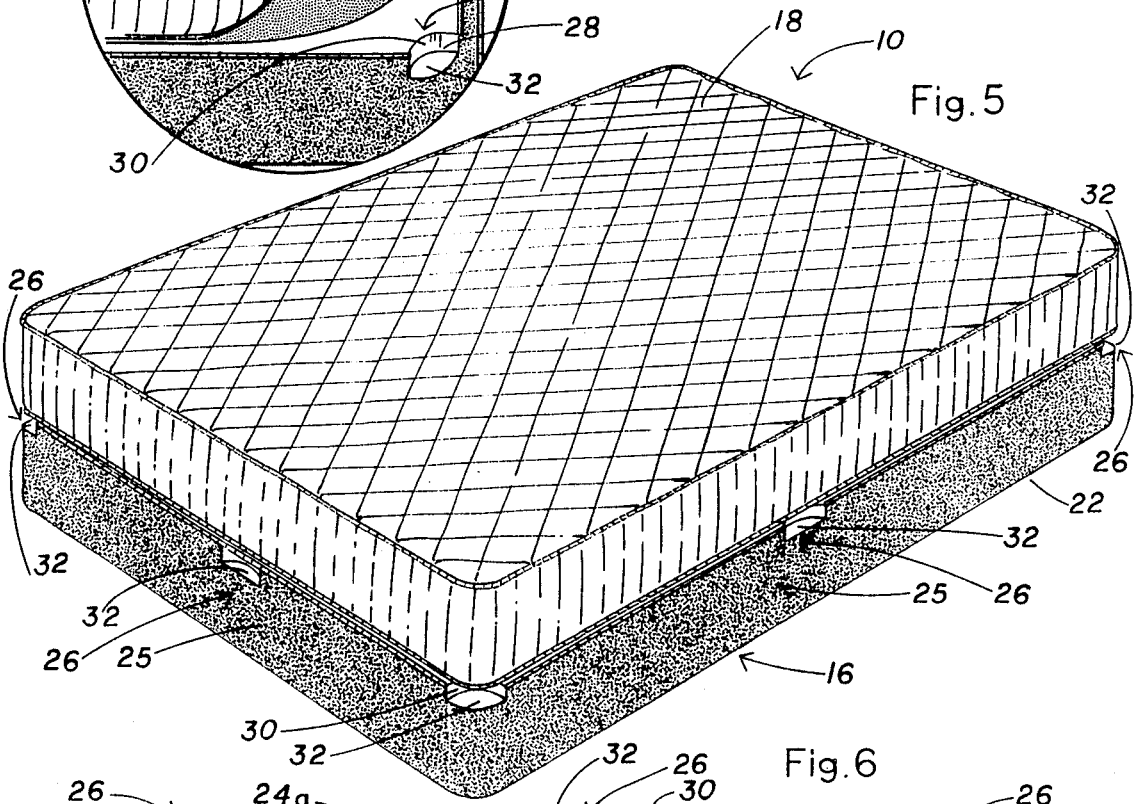
FIG. 5 is a pespective view of the mattress and mattress support set of the present invention.
Figure 6:
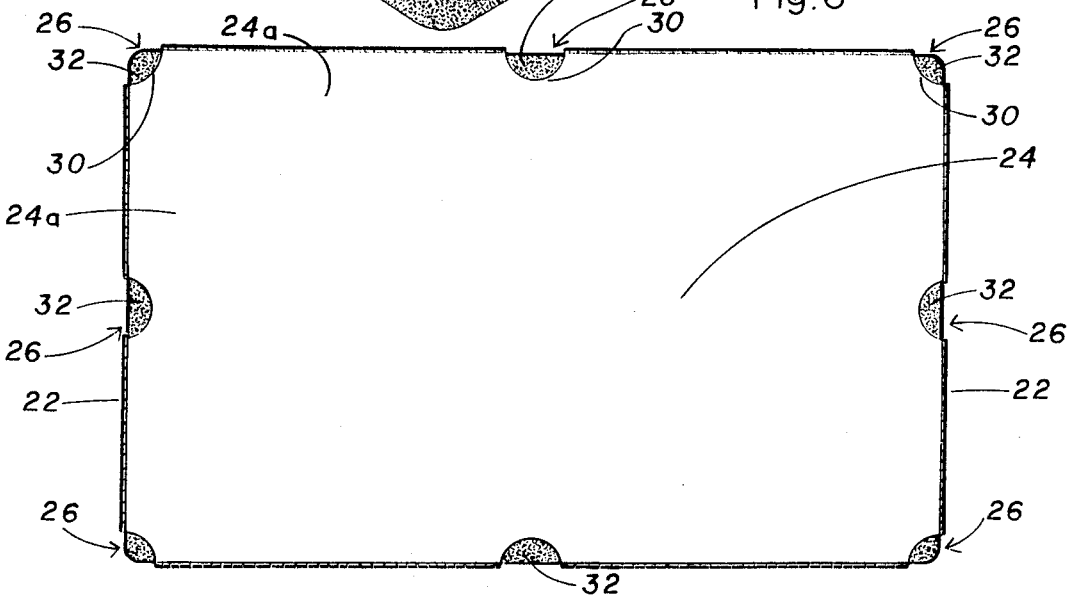
FIG. 6 is a top plan view of the box springs or mattress support structure of the present invention.

Turning to FIG. 5, there is shown therein a mattress and mattress support set indicated generally by the numeral 16. Mattress and mattress support set 16 include a mattress 18 having an underside 20. Underside 20 includes a surrounding perimeter area **20*a*. Secured at selected locations around the underside perimeter 20*a* is a series of second attachment means or fastening means 21. The second attachment means 21 is also preferably of the velcro type and adapted to cooperate with the first attachment means 14 associated with the sheet 10 for the particular purpose of securing sheet 10 to the mattress 18. Therefore, it is appreciated that the second attachment means 21 would cooperate with the first attachment means 14 to secure the sheet about the mattress 18. It is seen in FIG. 3 that the attachment means 21 secured about the underside of mattress 18 are secured about respective corner portions and along four sides with the attachment means that are secured along the four sides of the mattress being secured between corner portions of the mattress 18**.

Also forming a portion of the mattress and mattress support set 16 is a box springs or mattress support 22. The mattress support 22 includes a top 24 and a top surrounding perimeter 24*a*. In addition, mattress support 22 includes a surrounding side wall 25. Formed about the top perimeter area 24*a* and about the side wall 25 of the mattress support 22 is a series of recesses indicated generally by the numeral 26. Each recess includes a side access opening 28, a recess wall 30, and a recess base 32.

As seen in the drawings, there is a relationship between the respective recesses 26 and the attachment means 21 secured to the underside of mattress 18. In particular, the respective recesses 26 underly the velcro attaching strips 21 secured about selected locations around the underside of mattress 18. It is appreciated that the respective recesses 26 enable an individual to quickly and easily gain access to the velcro attaching strips 21 secured to the underside of mattress 18 without having to lift the mattress above the box springs or mattress support 22.

To secure sheet 10 securely to mattress 18, an individual will grasp a portion of sheet 10 having the first attachment means or velcro strip 14 associated therewith. Once that portion of the sheet 10 has been grasped, it is a simple matter to attach the same to the underlying attachment means or cooperating velcro strip 21 secured or formed on the underside of mattress 18. This is because the respective recesses 26 underlying the velcro strips 21 enable the grasped velcro portion of the sheet 10 to be passed conveniently through the recesses 26 and into engagement with the velcro attaching strips 21 secured to the underside of mattress 18. Consequently, it is appreciated that there is no requirement for lifting the mattress 18 but yet one is able to secure the sheet to the most advantageous portion of the mattress 18, that portion being the underside of the mattress 18. By securing the sheet 10 to the underside of the mattress 18, then it becomes very difficult to unintentionally break the secured relationship between the cooperating attachment means 14 and 21.

Therefore, it is appreciated that the present invention presents a convenient and easy to use system and method for attaching a bed sheet to a mattress. Of particular importance is the fact that the present system enables the bed sheet to be quickly and easily attached to the underside of the mattress where it becomes very difficult to inadvertently break the formed connection. In addition, by the designing of the box springs or mattress support with the recesses 26, one is able to quickly and easily make the underside mattress attachment without having to lift or even move a sometimes heavy and bulky mattress.

The present invention may, of course, may be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A mattress and mattress support set for accommodating a sheet having attachable securing means located at selected locations about the perimeter of the sheet comprising:

(a) a mattress having an underside and a plurality of fastening means stationed about the perimeter of the underside of the mattress for cooperating with the attachable securing means of the sheet for securing the sheet to the mattress;

(b) a mattress support structure for supporting the mattress and having an upper side;

(c) a series of recesses spaced about the perimeter of the upper side of the mattress support; and (d) the recesses being particularly spaced to correspond to the spacing of the fastening means such that when the mattress is supported by the mattress support the respective fastening means formed on the underside of the mattress overlay respective recesses such that one may conveniently secure the attachable securing means of the sheet with the cooperating fastening means formed on the underside of the mattress.

2. The mattress and mattress support set of claim 1 wherein the mattress and mattress support includes a plurality of corners and wherein the cooperating fastening means formed on the underside of the mattress are selectively secured adjacent the respective corners of the mattress and wherein the recesses formed in the mattress support are formed adjacent the respective corners of the mattress support.

3. The mattress and mattress support structure of claim 2 wherein the cooperating fastening means are also located along opposite sides and ends of the mattress intermediately between the corners and wherein the recesses formed in the mattress support include recesses of the mattress support intermediately between the corners, sides and ends.

4. The mattress and mattress support structure of claim 1 wherein the mattress support structure includes a surrounding side wall and wherein respective recesses are formed in the side wall and include an access side opening, a surrounding recess wall and a recess base.

5. The mattress and mattress support structure of claim 4 wherein when the mattress is supported by the mattress support structure, a respective fastening means secured to the underside of the mattress overlies the recess base and wherein easy access can be gained to the fastening means through the access side opening of the recess.

6. A sheet, mattress and mattress support structure comprising:

(a) a sheet having a plurality of first attachment means secured about the perimeter of the sheet;

(b) a mattress with an underside and a plurality of second attaching means stationed about the perimeter of the mattress underside for cooperating with the first attachment means of the sheet for securing the sheet to the mattress;

(c) a mattress support structure for supporting the mattress and having an upper side;

(d) a series of recesses spaced about the perimeter of the upper side of the mattress support; and (e) the recesses being particularly spaced to correspond to the spacing of the second attachment means such that when the mattress is supported by the mattress support the respective second attachment means formed on the underside of the mattress overlay respective recesses such that one may conveniently secure the first attachment means of the sheet with the second attachment means formed on the underside of the mattress.

7. A method of attaching and securing a sheet to the underside of a mattress supported on a mattress support having a plurality of access openings formed around a side wall forming a part of the mattress support structure comprising:

(a) grasping a perimeter portion of the sheet having an attaching means formed thereon; and (b) passing the grasped portion of the sheet through an access opening and attaching a portion of the sheet that has been passed through the access opening to cooperating attaching means formed on the underside of the mattress.

* * * * *